United States Patent [19]

Hanson et al.

[11] Patent Number: 4,701,731

[45] Date of Patent: Oct. 20, 1987

[54] PIVOTABLE CONICAL JOINT FOR WAVEGUIDES

[75] Inventors: Allan W. Hanson, Los Angeles; Theron L. Christiansen, Hawthorne, both of Calif.

[73] Assignee: Hughes Aircraft Company, Los Angeles, Calif.

[21] Appl. No.: 854,969

[22] Filed: Apr. 23, 1986

[51] Int. Cl.[4] ..... H01P 1/06

[52] U.S. Cl. ..... 333/257; 333/248

[58] Field of Search ..... 333/256, 257, 248, 254, 333/255

[56] References Cited

U.S. PATENT DOCUMENTS 2,632,807 3/1953 Kirkpatrick et al. ..... 333/256

3,155,923 11/1964 Persson ..... 333/254 X

OTHER PUBLICATIONS

*MDL Waveguide Flange Catalog FA-61A*, Microwave Development Laboratories, Natick, Mass., Mar. 1963.

*Primary Examiner*—Paul Gensler

*Attorney, Agent, or Firm*—S. M. Mitchell; M. J. Meltzer; A. W. Karambelas

[57] ABSTRACT

A pivotal joint for waveguides provides a low-loss interface between two rigid waveguides at which relative movement can occur. The pivotal joint has two waveguide sections which are terminated in conical surfaces containing concentric chokes to minimize RF energy leakage. A universal gimbal is utilized to position the joints so that the pivotal motion occurs about the apices of the chokes. The advantages of this RF joint include zero bending torque, absence of a fatigue failure mode, low insertion loss and a good impedance match at all angles of operation and over large bandwidths.

5 Claims, 5 Drawing Figures

FIG. 1.
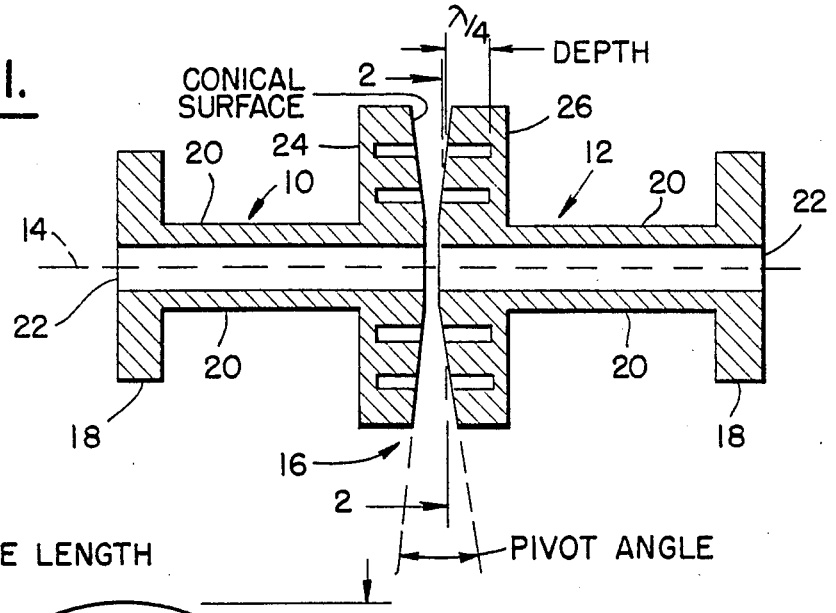
λ = WAVE LENGTH
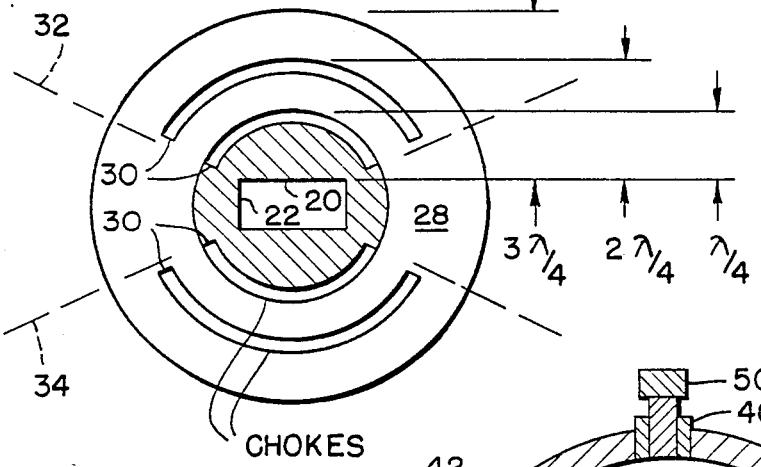
FIG. 2.
FIG. 5.
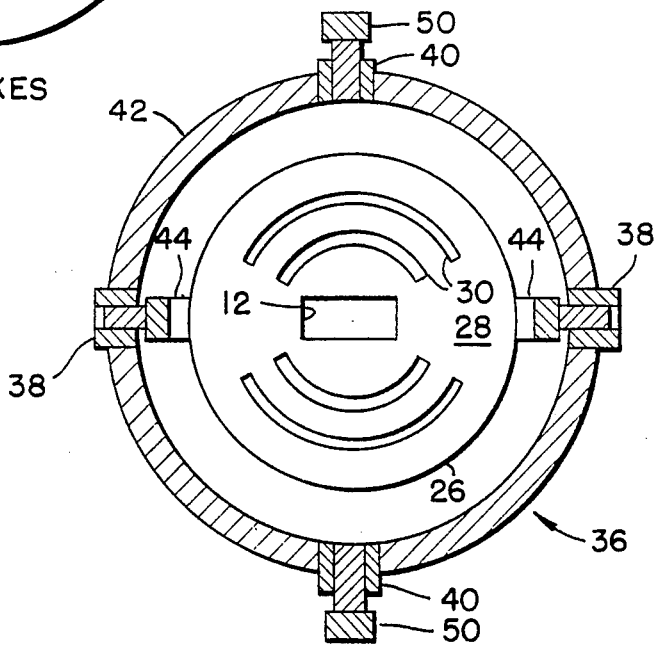

PIVOTABLE CONICAL JOINT FOR WAVEGUIDES

BACKGROUND OF THE INVENTION

This invention was made with Government support under a contract awarded by the United States Government. The Government has certain rights in this invention.

This invention relates to the transmission of radiant energy via waveguides and, more particularly, to a device for joining two waveguides while permitting a pivoting of one waveguide relative to the other waveguide.

Waveguides are frequently employed for the transmission of electromagnetic radiation from one location to another location. For example, the waveguide may be employed to couple electromagnetic energy from a transmitter to an antenna from which the energy is radiated. As a further example, a waveguide may couple an antenna to a receiver of the radiant energy.

A problem arises in situations wherein rigid waveguide is employed in an installation which may introduce a transverse vibratory motion, or wherein a pivoting of one section of rigid waveguide relative to a second section of rigid waveguide is required.

Such pivoting may be required in a coupling of a transmitter or a receiver to an antenna which is mechanically scanned. Transverse vibration may occur in a relatively lengthy waveguide run in a vehicular installation wherein movement of the vehicle, such as a ship or aircraft, may produce such vibration. Such pivoting and vibration introduces the need for a joint which can connect two sections of rigid waveguide for coupling electromagnetic energy between the two waveguide sections while allowing one of the waveguide sections to move relative to the other waveguide sections as by a pivoting movement. The foregoing problem is complicated by the fact that movable waveguide joints may not have sufficient bandwidth to pass all frequencies of interest in a microwave signal transmitted from one of the waveguide sections to the other of the waveguide sections. In addition, the joint might not have a desired capability for pivoting in two orthogonal planes.

SUMMARY OF THE INVENTION

The foregoing problem is overcome and other advantages are provided by a joint for waveguides, which joint, in accordance with the invention, allows for pivoting of one waveguide relative to another waveguide in each of two orthogonal planes while coupling radiant energy between the two waveguides. The joint is formed by two flange assemblies which face each other and are disposed on the ends of the respective ones of the waveguides which are to be joined together. The two flange assemblies are spaced apart, so as to avoid contact during a pivoting motion, the spacing of the two assemblies being much smaller than a wavelength of the radiation, preferably less than one-twentieth of the midband wavelength of electromagnetic signals transmitted via the waveguides.

In accordance with a feature of the invention, the faces of the flanges are structured with a conical surface, the apices of the conical surfaces facing each other. In each flange assembly, an axis of the conical surface coincides with the longitudinal axis of the respective waveguide. In each of the conical surfaces, the cone angle, as measured between the cone axis and a generating ray of the conical surface, is approximately 84°. The cone angle allows for a rocking or pivoting movement of a waveguide through a total angle of 6° relative to a transverse plane between the two waveguides. Since each waveguide is able to pivot through an angle of 6° relative to the transverse plane, the total pivoting angle provided by the joint is 12°. The 12° pivoting angle has been employed in a preferred embodiment of the invention, however, it is to be understood that the foregoing angles may be increased or decreased as may be desired providing that, in general, the total pivot angle should be less than approximately 14° to prevent excessive leakage of electromagnetic energy between the facing surfaces of the joint.

In accordance with a further feature of the ivnention, the electromagnetic energy is retained within the joint by means of an RF (radio frequency) choke assembly composed of a set of arcuate channels located on the conical surfaces and extending into the conical surfaces a distance of one-quarter wavelength of the midband radiation In each flange assembly, the channels are formed as coaxial circular segments, each of which extends partway around, but not completely around, the cone axis. In each flange assembly, two rows of the channels are provided, the rows being spaced apart in the radial direction by a quarter wavelength of a midband radiation. Each of the channels serves electromagnetically as a choke, and the assembly of chokes is effective for retaining the radiation within the waveguides and the joint.

BRIEF DESCRIPTION OF THE DRAWING

The foregoing aspects and other features of the invention are explained in the following description, taken in connection with the accompanying drawing wherein:

FIG. 1 is a view, taken in longitudinal section, of two sections of waveguide coupled by a joint embodying the invention;

FIG. 2 is a sectional view taken along the line 2—2 of FIG. 1 to show details of a face of a flange assembly of the joint;

FIG. 5 is a sectional view along the line 5—5 in FIG. 4 showing the face of a flange assembly and portions of the gimbal mounting.

DETAILED DESCRIPTION

Figure 4:
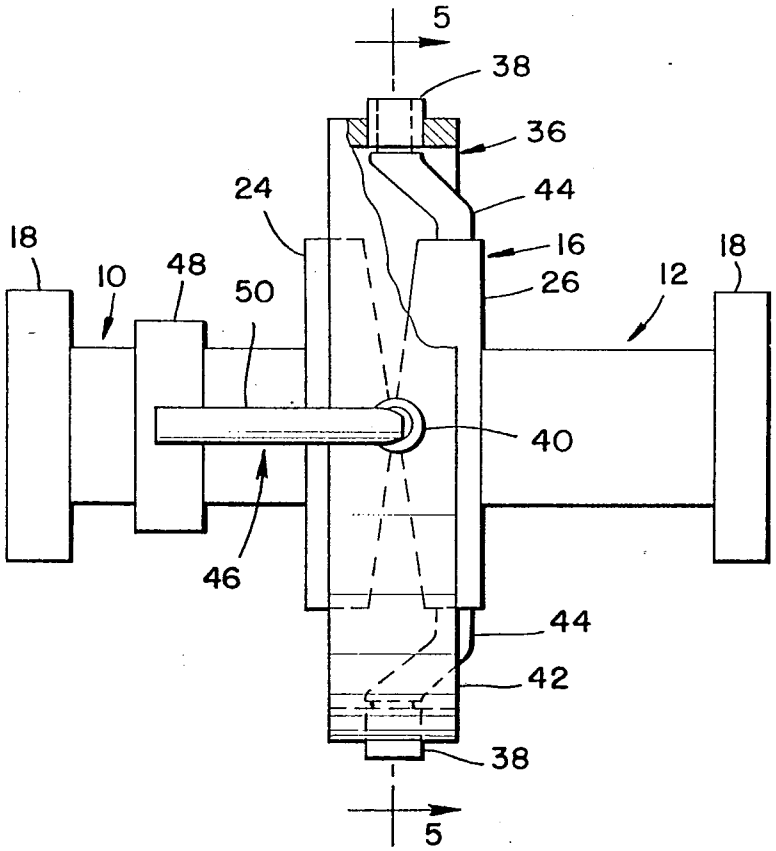
FIG. 4 shows a top view of the joint including the gimbal mounting taken along the line 4—4 in FIG. 3, the view of FIG. 4 being partially cut-away to show a pivoting member of the gimbal mounting.

With reference to FIGS. 1 and 2, two waveguides 10 and 12 are disposed along a common longitudinal axis 14 and are coupled together electromagnetically by a joint 16. Each of the waveguides 10 and 12 is provided with suitable means, such as a flange 18, for joining to further sections of waveguide (not shown) or to other microwave equipment such as a transmitter or antenna (not shown). By way of example, in the construction of the waveguides 10 and 12, each of the waveguides is provided with a pair of opposed broad walls 20 and a pair of opposed short walls 22 which give a rectangular cross-section to each of the waveguides.

In accordance with the invention, the joint 16 comprises two flange assemblies 24 and 26 which are of identical construction. The flange assembly 24 is mounted on an end of the waveguide 10. The flange assembly 26 is mounted on an end of the waveguide 12 and faces the flange assembly 24. A face 28 of each of the flange assemblies 24 and 26 is formed with a convex conical surface of which the apex lies on the axis 14. The conical surface extends up to the edges of the waveguide walls 20 and 22. As may be seen in the sectional view of FIG. 1, the conical surfaces appear as straight lines angled to each other at an angle of 12°. This angulation permits the pivoting of the waveguide 10 relative to the waveguide 12.

In accordance with a further feature of the invention, electromagnetic energy propagating through the joint 16 is retained within the joint 16 so as to prevent leakage into the external environment, this being accomplished by a set of channels 30 provided in each of the faces 28 of the joint 16. The channels are formed each as a circular segment, and are mounted coaxially about an axis of the conical surface in each of the flange assemblies 24 and 26. In the embodiment of FIGS. 1 and 2, the flange assemblies 24 and 26 are mounted perpendicularly to their respective waveguides 10 and 12; this results in the conical axes coinciding with the axis 14.

In the construction of the channels 30, it has been found to be important to extend a channel 30 only partway around the face 28. A complete encirclement by a channel 30 has been found to sustain certain modes of resonance which induce leakage of the electromagnetic radiation. In the construction of the preferred embodiment, as depicted in FIG. 2, the ends of the channels 30 are set at the diagonals 32 and 34 of the waveguide 12. The construction is applied in the flange assembly 24.

Each channel 30 functions electromagnetically as a choke. In the preferred embodiment of the invention, in each of the flange assemblies 24 and 26, two of the channels 30 are positioned alongside a broadwall 20, and two of the channels 30 are located alongside the opposite broadwall 20. The spacing on centers between the two channels on one side of the face 28 is equal to the spacing between the broadwall to the nearest channel 30 and is also equal to the spacing between the periphery of the face 28 and the outer channel, each of these spacings being equal to one-quarter wavelength of the midband radiation. The depth of each channel 30 is also equal to one-quarter wavelengths at the midband radiation. The width of a channel 30 is less than approximately one-tenth of the midband wavelength.

The spacing between the two flange assemblies 24 and 26 at their closest point of approach is 0.01 inches in the preferred embodiment of the invention, this being less than the aforementioned one-twentieth of the midband wavelength. This spacing is maintained by a gimbal mounting 36 which will now be described with reference to FIGS. 3–5.

Figure 3:
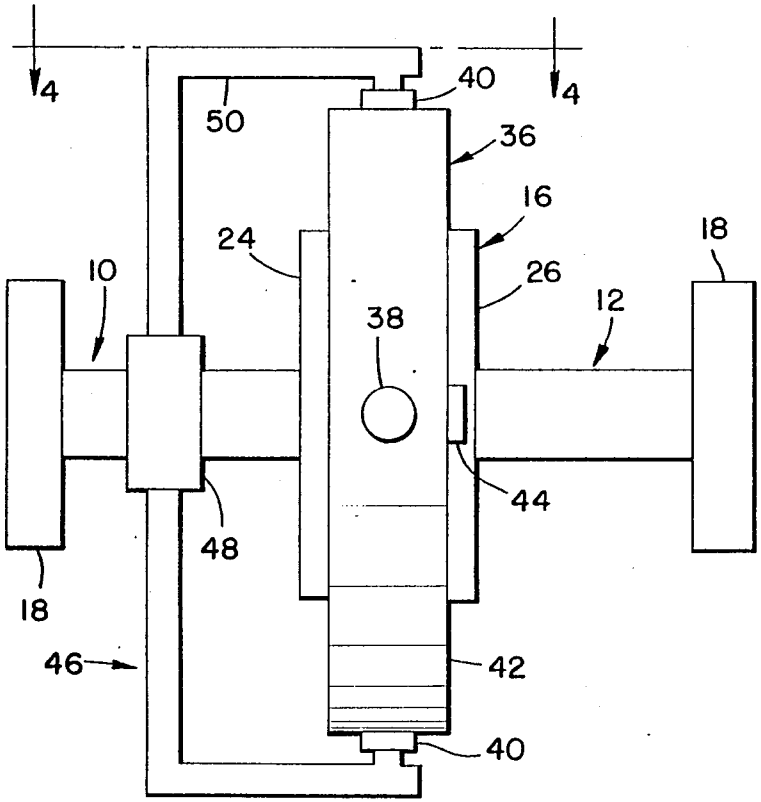
FIG. 3 is a side elevation view of a universal gimbal mounting which supports one flange assembly of the joint for pivoting relative to the other flange assembly of the joint.

As shown in FIGS. 3–5, the gimbal mounting 36 extends radially outward in a central transverse plane of the joint 16 and encircles each of the flange assemblies 24 and 26. The mounting 36 permits pivoting in two orthogonal planes corresponding to first and second pivot axes of pivots 38 and 40. The mounting 36 comprises a circular ring 42 which supports the pivots 38 and 40. A pair of struts 44 extend radially outward from the flange assembly 26 and then curve towards the central transverse plane of the joint 16 to engage with the pivots 38. All of the pivots 38 and 40 are located along the transverse central plane of the joint 16. A yoke 46 is fastened by a brace 48 to the waveguide 10, and includes arms 50 which engage with the pivots 40. The arms 50 approach the pivots 40 from outside of the ring 42, while the struts 44 approach the pivots 38 from inside the ring 42. The foregoing construction of the gimbal mounting 36 permits the two flange assemblies 24 and 26 to be pivoted in any direction relative to each other while maintaining the spacing between the two flange assemblies 24 and 26.

In addition to providing the foregoing pivoting function, the foregoing construction of the joint 16 has also been found to provide low insertion loss, less than one dB (decibels), and a good impedance match, standing wave ratio of better than 1.1, at all angles of operation over a bandwidth of greater than 25%. The choke assembly provided by the channels 30 in each of the faces 28 retains the radiation within the joint 16 and allows no more than a negligible amount of leakage between the faces 28 of the flange assemblies 24 and 26. The foreging spacings between the channels 30, and their respective depths, are selected so as to produce a short circuit to electromagnetic fields at the waveguide E-plane boundaries at the broadwalls 20. The short circuits appear electrically as a continuum of the waveguides 10 and 12 through the joint 16.

Each of the waveguides 10 and 12 and the respective flange assemblies 24 and 26 are fabricated conveniently of an electrically conducting material such as brass. The channels 30 may be constructed within the flange assemblies 24 and 26 by conventional milling, after which the flange assemblies 24 and 26 may be mounted to the ends of the respective waveguides 10 and 12 in a conventional manner as by brazing. The gimbal mounting may be fabricated of a rigid material which may be a metal such as brass or of a rigid plastic material such as nylon.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

We claim:

1. A joint for pivotally coupling two waveguides comprising:

a first flange assembly having a convex conical surface disposed about an end of a first one of said waveguides, and oriented transversely to a longitudinal axis of said first waveguide;

a second flange assembly having a convex conical surface facing said first flange assembly, said second flange assembly being disposed about an end of a second one of said waveguides, and oriented transversely to a longitudinal axis of said second waveguide;

means for pivotally mounting said first flange assembly relative to said second flange assembly with a spacing therebetween of less than approximately one-twentieth wavelength of radiation transmitted via said joint between said first and said second waveguides;

an assembly of chokes disposed along the conical surface of each of said flange assemblies, each choke assembly including a set of four chokes, there being in each flange assembly an inner choke and an outer choke on one side of said waveguide, and an inner choke and an outer choke positioned diametrically across the flange assembly on the opposite side of said waveguide, each choke being formed as a channel disposed within the conical surface in each of said flange assemblies and having the shape of a circular segment;

the chokes of each choke assembly being arranged with radial symmetry about a cone axis of the respective conical surfaces, the inner chokes on each surface being positioned alongside a broadwall of the respective waveguide in each of the flange assemblies; and the radial spacing between a center line of each adjacent inner and outer choke being one-quarter wavelength at the midband frequency of radiation propagating through said joint.

2. A joint according to claim 1 wherein the spacing between a center line of the inner ones of said chokes and the adjacent broadwall of the respective waveguides is one-quarter wavelength of the midband radiation.

3. A joint according to claim 1 wherein the spacing between the outer ones of said chokes and a periphery of each respective flange assembly is onequarter wavelength at the midband frequency of radiation propagating through said joint.

4. A joint according to claim 2 wherein the spacing between the outer ones of said chokes and a periphery of each respective flange assembly is one-quarter wavelength at the midband frequency of radiation propagating through said joint..

5. A joint according to claim 4 wherein the channels in each said choke assemblies are arranged with radial symmetry about the cone axis, the ends of the channels lying on common diagonals of the respective waveguides to which said flange assemblies are mounted.

* * * * *